US005698935A

United States Patent [19]

Newman

[11] Patent Number: 5,698,935

[45] Date of Patent: Dec. 16, 1997

[54] LAMPHOLDER SYSTEM WITH MOGUL BASE

[75] Inventor: Walter Newman, Bayside, N.Y.

[73] Assignee: Leviton Manufacturing Co., Inc., Little Neck, N.Y.

[21] Appl. No.: 647,494

[22] Filed: May 14, 1996

Related U.S. Application Data

[63] Continuation of Ser. No. 232,568, Apr. 25, 1994, abandoned.

[51] Int. Cl.[6] ..... H01J 5/00

[52] U.S. Cl. ..... 313/318.04; 439/133; 439/615

[58] Field of Search ..... 313/318.04; 439/340, 439/133, 135, 613, 615

[56] References Cited

U.S. PATENT DOCUMENTS

| | | | |
|---|---|---|---|
| 283,270 | 8/1883 | Mott | 439/615 |
| 383,616 | 5/1888 | Byllesby et al. | 439/613 |
| 535,838 | 3/1895 | Lowe | 313/113 |
| 1,156,650 | 10/1915 | Wright | 439/615 |
| 1,345,091 | 6/1920 | Kellogg | 439/133 |
| 1,628,183 | 5/1927 | Pendleton | 439/683 |
| 1,705,559 | 3/1929 | Dubilier | 336/65 |
| 1,988,290 | 1/1935 | Wright | 313/271 |
| 2,051,169 | 8/1936 | Handschug | 439/133 |
| 2,291,808 | 8/1942 | Henning | 439/563 |
| 2,522,907 | 9/1950 | Streb | 439/135 |
| 2,958,006 | 10/1960 | Kirka | 315/58 |
| 3,060,344 | 10/1962 | Scholes | 315/58 |
| 3,107,134 | 10/1963 | Kerrigan | 439/135 |
| 3,248,685 | 4/1966 | Knuppel | 439/339 |
| 3,265,922 | 8/1966 | Verbeel | 313/318.04 |
| 3,281,620 | 10/1966 | Miller | 313/113 |
| 3,315,216 | 4/1967 | Krupp et al. | 439/662 |
| 3,489,991 | 1/1970 | Hilzen | 439/340 |
| 3,568,133 | 3/1971 | Johnson | 439/375 |
| 3,599,169 | 8/1971 | Detch | 439/383 |
| 3,711,768 | 1/1973 | Frazin | 324/507 |
| 3,783,435 | 1/1974 | Fisher | 439/340 |
| 3,827,003 | 7/1974 | Sullivan | 439/665 |
| 3,936,122 | 2/1976 | Hagelberg | 439/138 |
| 3,995,876 | 12/1976 | Knüppoz | 280/476.1 |
| 4,382,654 | 5/1983 | Schick | 439/602 |
| 4,412,109 | 10/1983 | Schaad et al. | 200/16 C |
| 4,429,942 | 2/1984 | Johnson et al. | 439/662 |
| 4,441,782 | 4/1984 | Kneer | 439/340 |
| 4,752,245 | 6/1988 | Knecht | 439/677 |
| 4,924,134 | 5/1990 | Westlund, Jr. et al. | 313/113 |
| 4,934,963 | 6/1990 | Gardner et al. | 439/677 |
| 4,990,820 | 2/1991 | Suster et al. | 313/49 |
| 5,069,632 | 12/1991 | Avitan | 439/188 |
| 5,108,311 | 4/1992 | Nakazawa | 439/677 |
| 5,263,881 | 11/1993 | Henrici et al. | 439/686 |
| 5,398,178 | 3/1995 | Roth | 362/296 |
| 5,573,419 | 11/1996 | Chen | 439/340 |

FOREIGN PATENT DOCUMENTS 2214364A 8/1989 United Kingdom .

*Primary Examiner*—Mark R. Powell
*Assistant Examiner*—Lawrence O. Richardson
*Attorney, Agent, or Firm*—Paul J. Sutton

[57] ABSTRACT

A lampholder for shrouded low-wattage metal halide lamps which include a contact button on an extension of the lamp base to distinguish them from unshrouded lamps. A hub with walls and top is placed about the entrance to an additional cavity in the lampholder body. A socket contact is arranged to only make contact with the contact button at the end of an extension which is able to enter the cavity and not make contact with a contact button not on an extension which is prevented from entering the cavity.

1 Claim, 3 Drawing Sheets

LAMPHOLDER SYSTEM WITH MOGUL BASE

This application is a continuation, under the provisions of 37 C.F.R. §1.60, of application Ser. No. 08/232,568, filed Apr. 25, 1994 now abandoned.

BACKGROUND OF THE INVENTION

1. Field of the Invention

The present invention pertains generally to lampholders for receiving lamps and more particularly to a family of lampholders for use with low wattage mogul base metal halide lamps which accepts only lamps having a particular base structure while rejecting all others.

2. Description of the Prior Art

The prior art teaches metal halide lamps which include a relatively centrally located arc tube situated within the confines of an outer glass bulb. These arc tubes are conventionally made of quartz and operate at extremely high temperatures and relatively high pressures. Under certain undesirable conditions, a system failure or internal factors will result in a safety hazard being created, whereby a violent shattering of the arc tube will send hot glass and lamp parts into contact with the bulb glass which, in turn, will break, releasing the hot glass and lamp parts into the surrounding environment. Under such conditions, there is an obvious risk of severe personal injury, fire and/or property damage.

For this reason, normally such conventional metal halide lamps are supported within what are referred to as "enclosed" fixtures whose structure is designed to contain violently released hot glass and lamps parts. A cover lens is used in such fixtures. In addition, significant reductions in such potential violent failures can be achieved by relamping before the rated end of the life of the lamp. Another conventional manner in which such potential violent failures is reduced includes the user's periodically turning off the lamp to permit its cooling, so that upon relighting, a non-violent or less violent lamp failure is facilitated.

SUMMARY OF THE INVENTION

Relatively recently, there has been a development in the field of low wattage metal halide lamp technology which affects both lamps and lampholders. Manufacturers of metal halide lamps are selling lamps for use in what are referred to as "open" fixture, in which the lamp is mounted such that it is exposed during its use. In order to reduce or eliminate the risks associated with violent lamp failures in non-enclosed environments, a newer metal halide lamp has been developed by manufacturers such as Venture Lighting in which a relatively thick shroud of quartz is situated intermediate the arc tube and the outer bulb glass such that, it the event of a violent lamp failure of the type described above, the shroud is intended to intercept and contain the hot glass and lamp parts which would otherwise impact and possibly break the bulb glass. The intended result is a less expensive and equally safe lamp and fixture combination suitable for indoor commercial lighting applications such as offices and retail spaces, as well as other environments.

However, to prevent the use of lamps intended to be used in an "enclosed" fixture in an "open" fixture, the newer "shrouded" lamp is provided with a different type of base so that the lamps intended for an open" fixture can be rapidly identified and separated from lamps that must be used in an "enclosed" fixture.

The instant invention provides a novel lampsocket which will accept and make electrical contact with the new shrouded lamps and will accept but not make electrical contact with the older unshrouded lamps. This is done by providing a central well in the floor of the lampsocket to accept the extension of the new lamp base and providing an electrical contact in such well which can only be contacted by a lamp contact which is placed at the end of the lamp base extension. An unshrouded lamp, lacking this extension and contact on such extension, can not extend into and engage the contact in the well. It is an object of the present invention to take advantage of the differences in lamp base configurations between shrouded and unprotected metal halide lamps to provide a safety lampholder which will functionally accept a shrouded lamp but not an unprotected, unshrouded lamp.

It is another object of the present invention to provide a safety lampholder system which will not supply electrical current to an unprotected or unshrouded metal halide lamp improperly attempted to be inserted therein, whether deliberately or inadvertently.

It is a further object of the present invention to eliminate a potential safety hazard condition associated with attempts to install unprotected metal halide lamps in "open" or non-enclosed fixtures.

Still another object is to provide a safety lampholder system whose internal structural configuration includes a base well with the central lamp contact member installed in such base well which prevents the central button contact of an unprotected metal halide lamp from coming into contact with the "live" or electrically conductive central lamp contact of the socket and thus such lamp can not be lit.

Other objects and features of the invention will be pointed out in the following description and claims and illustrated in the accompanying drawings, which disclose, by way of example, the principle of the invention and the best mode which is presently contemplated by carrying them out.

BRIEF DESCRIPTION OF THE DRAWING

In the drawings in which similar elements are given similar reference characters.

DESCRIPTION OF THE PREFERRED EMBODIMENT

Figure 1:
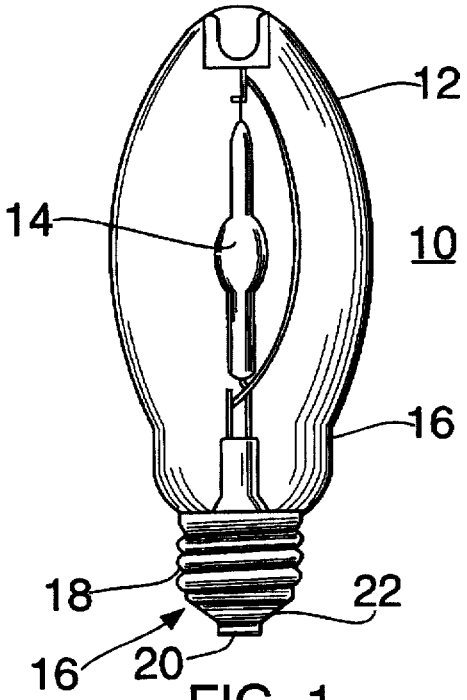
FIG. 1 PRIOR ART
FIG. 1 is a side elevational view of a conventional low wattage metal halide lamp intended for use in an "enclosed" fixture.

Turning now to FIGS. 1, 3, 5 and 6 there is shown a typical low wattage metal halide lamp 10 and a lampholder 50 for accepting and providing full electrical connection therewith. Lamp 10 has a glass bulb 12 within which is placed a quartz arc tube 14. Bulb 12 has a metal screw base 16 with the lower portion containing metal base threads 18. Any screw thread pattern can be chosen and the particular one shown is American Standard mogul threads, that is four threads per inch. The base 16 may be fabricated from any conductive metal such as copper or a copper alloy. A relatively flat contact 20, often termed a solder or button, also made of metal is mechanically but not electrically joined to the end of base 16 by an insulator 22, such as a non-conductive ceramic as is well known in the art. The base 16 is connected to one side of ark tube 14 while contact 20 is connected to the other.

Figure 5:
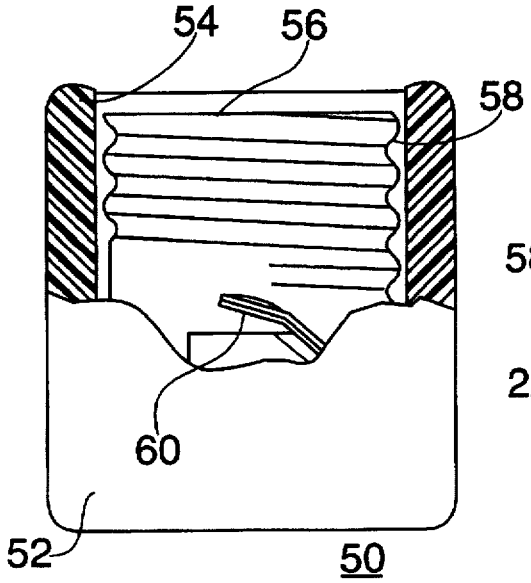
FIG. 5 PRIOR ART
FIG. 5 is a front elevational view, partly cut-away and partly in section, of a lampsocket body to receive and make electrical contact with an unshrouded, unprotected lamp.

In FIG. 5, a lampholder or lampsocket 50 is shown. Lampsocket 50 has a body 52 of insulating material such as rubber, plastic, porcelain or the like. Socket 54 contains a metal sleeve 56 on which are formed threads 58 complementary to base threads 18 of lamp 10. A metal contact arm 60 is arranged to contact flat contact or button 20 of lamp 10 and is electrically insulated from metal sleeve 56. Metal sleeve 56 is connected to one conductor of an AC supply (not shown) while contact arm 60 is connected to the second of such conductors of the AC supply (not shown) to provide current to operate lamp 10.

Figure 6:
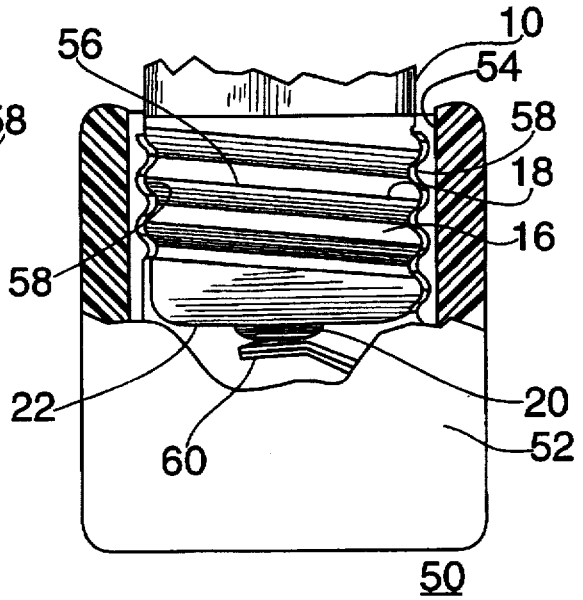
FIG. 6 PRIOR ART
FIG. 6 is the lampsocket of FIG. 5 with an unshrouded, unprotected lamp installed therein.

As shown in FIG. 6, lamp 10 has been inserted into lampholder 50 and metal base threads 18 advanced along metal socket threads 58 until button 20 makes solid contact with metal contact arm 60, allowing current to flow and lighting lamp 10.

Figure 2:
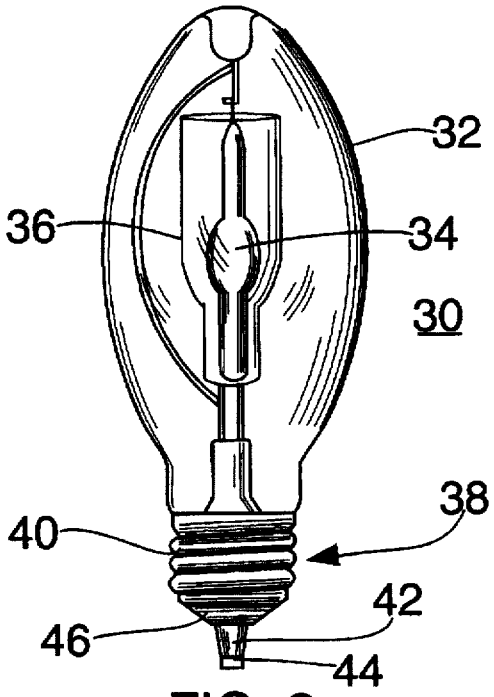
FIG. 2 is a side elevational view of the recently developed low wattage metal halide lamp intended for use in an "open" fixture modified to show the new base used for these lamps.
Figure 3:
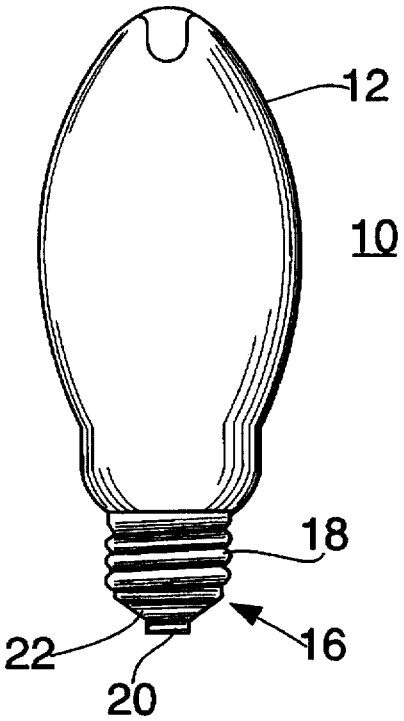
FIG. 3 PRIOR ART
FIG. 3 is a front elevational view of the lamp of FIG. 1.
Figure 4:
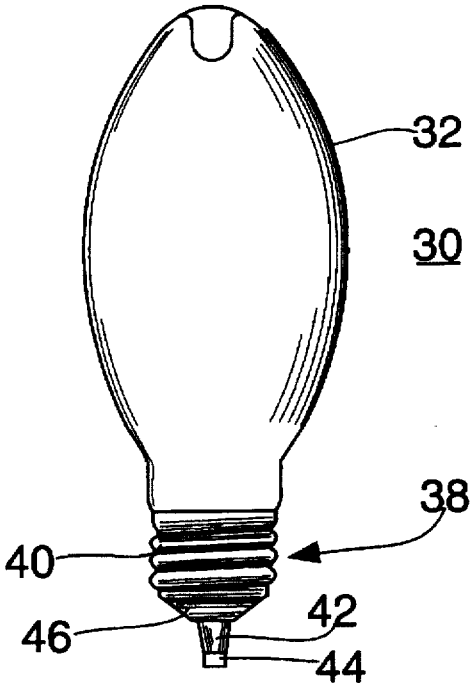
FIG. 4 is a front elevational view of the lamp of FIG. 2.
Figure 7:
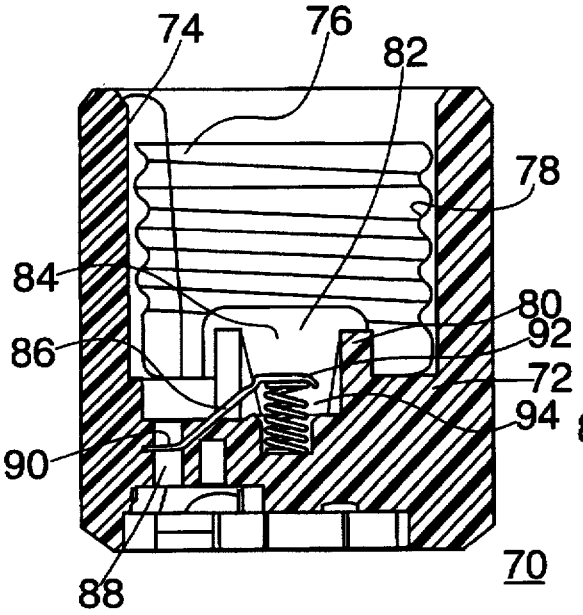
FIG. 7 is a front elevational view, in section, of a lampsocket constructed in accordance with the concepts of the invention.
Figure 9:
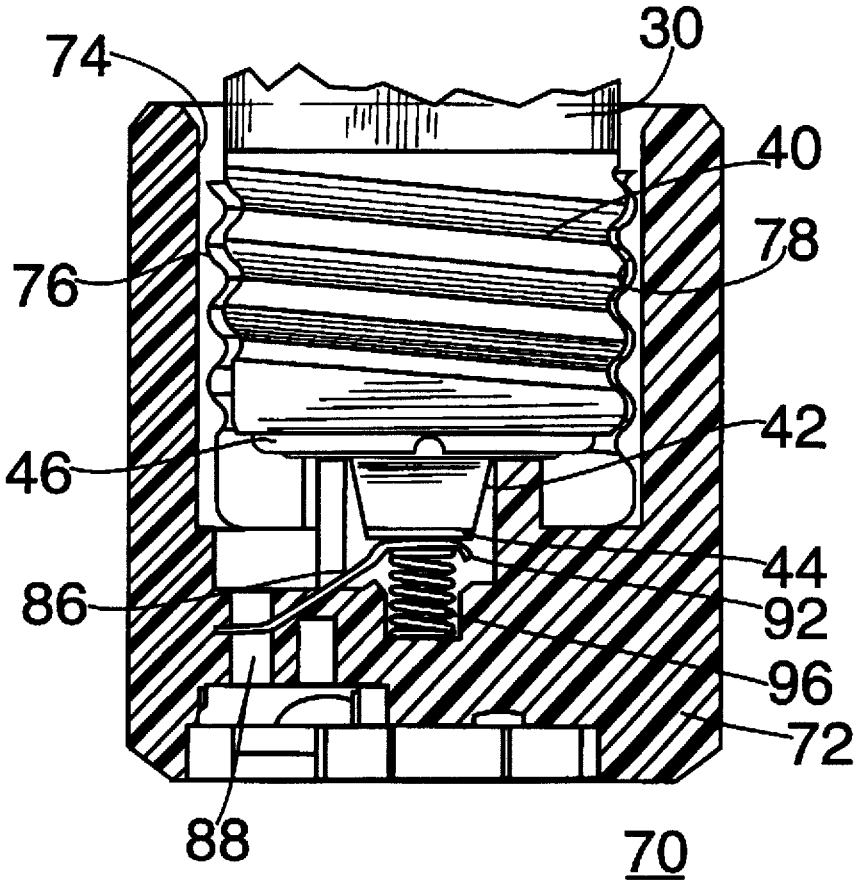
FIG. 9 is the lampsocket of FIG. 7, with a shrouded lamp positioned in and electrically connected thereby.

A lampsocket 70 constructed in accordance with the concepts of the invention is shown in FIGS. 7 and 9 to accept and make electrical contact with a shrouded lamp base as shown in FIGS. 2 and 4 to which reference is now made. Lamp 30 is a low wattage metal halide lamp intended for use in an "open" fixture. In addition to glass bulb 32 and quartz arc tube 34 there is a shroud 36 of thick quartz positioned about arc tube 34. The metal screw base 38 has metal base threads 40 on its lower portion. An extension 42 of insulating material joins metal button 44 to screw base 38 via an insulating flange 46. Again one side of the arc tube 34 is connected to metal screw base 38 while the other side is connected to button 44.

Lampholder 70 (see FIG. 7) has a body 72, fabricated from insulating material, containing a socket 74. Socket 74 contains a metal sleeve 76 on which are formed threads 78 complementary to base threads 40 of lamp 30. Sleeve 76 has a central raised hub 80 which has an aperture 82 in its center. Directly below aperture 82 is a cavity 84 in body 72. A metal contact arm 86 is cantilever mounted to a post 88 at a first end 90 and the free end 92 extends into cavity 84 below the aperture 82. A recess 94 in the floor of cavity 84 receives one end of a coil spring 96 whose other end engages the underside of contact arm 86 at free end 92. Coil spring 96 urges metal contact arm 86 upwardly against button 44 of lamp 30 when lamp 30 is positioned in lampholder 70.

Lamp 30 is placed in cavity 74 of lampholder 70 and threads 40 made to advance along internal threads 78 by rotating lamp 30. Extension 42 enters the aperture 82 in hub 80 and button 44 engages contact arm 86. A good electrical contact between button 44 and arm 86 is assured by the coil spring 96 which urges arm 86 into contact with button 84. The insulating flange 46 contacts hub 80 about aperture 82 and limits downward insertion of lamp 30. Post 88 is connected to one supply conductor while sleeve 76 is connected to the other to supply current to lamp 30.

Figure 8:
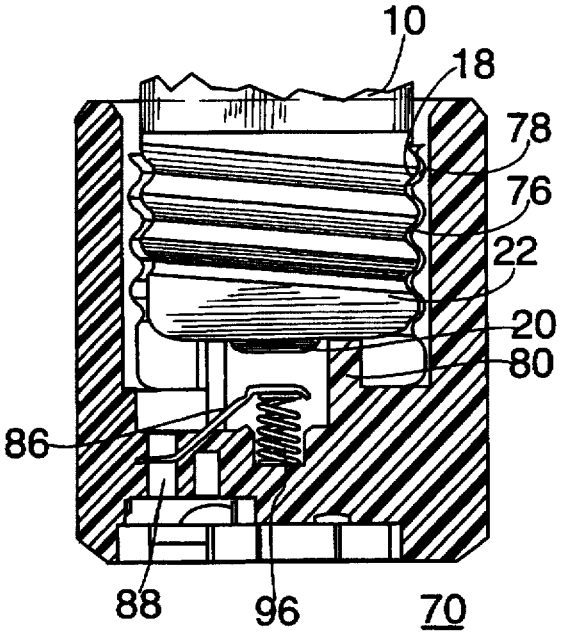
FIG. 8 is the lampsocket of FIG. 7, with an unshrouded, unprotected lamp positioned in but not electrically connected thereby.

In the event that one tries to employ a lamp 10 in a lampholder 70, the following occurs as is shown in FIG. 8. Threads 18 of lamp 10 engage threads 78 of sleeve 76 and lamp 10 advances until insulator 22 comes to rest upon hub 80. Contact 20 extends into aperture 82 to cavity 84. However, because of the absence of any extension similar to extension 42, the contact 20 is spaced quite a distance above contact arm 86 and no electrical contact is made. Accordingly, lamp 10 cannot be supplied with the current required to light the lamp 10.

Thus the lampholder 70 will only accept and electrically connect lamps 30 having the extension 42 indicative of a lamp intended for "open" fixture use, and will accept but not electrically connect lamps 10 intended for "enclosed" fixtures.

While there have been shown and described and pointed out the fundamental novel features of the invention as applied to the preferred embodiment, it will be understood that various ommissions and substitutions and changes of the form and details of the device illustrated and in its operation may be made by those skilled in the art, without departing from the spirit of the invention.

The embodiment of the invention in which an exclusive property or privilege is claimed are defined as follows:

1. A lampholder for completing an electrical circuit with only those members of a class of lamps having a threaded external sleeve about a base member and a central button contact mounted on an insulated extension of said base member comprising:

a) a lampsocket body of insulating material having an open first end and a closed second end and a bore therebetween;

b) a metal sleeve in said bore of said lampsocket body adapted to be connected to one side of an AC voltage supply;

c) internal threads on said sleeve to receive in cooperative relationship said threaded external sleeve about said base member of an inserted lamp from said class of lamps, said metal sleeve electrically connecting said one side of said AC voltage source to the threaded external sleeve about said base member of a lamp threadably engaging said metal sleeve;

d) a cavity in said lampsocket body adjacent said closed second end and communicating with said bore to receive said extension of a lamp of said class threadedly introduced into said lampsocket body;

e) a contact means in said cavity having a first end cantilever mounted in said lampsocket body and a second, free end extending into said cavity to engage only said central button contact mounted on an insulated extension of said base member of a lamp of said class inserted in said lampsocket body, said contact means adapted to be connected to the second side of said AC voltage supply;

f) a recess in the interior of said second closed end communicating with said cavity;

g) a compression spring having a first end and a second end, said first end in said recess and the second end engaging the second, free end of said contact means to urge said contact means second end into intimate contact with a central button contact in said cavity; and h) hub means in said cavity to limit the movement of a lamp base member into said cavity;

whereby only those members of a class of lamps that have a central button contact mounted on an extension are electrically connected across both sides of an AC voltage supply.

* * * * *